US006217076B1

(12) United States Patent
Howard et al.

(10) Patent No.: US 6,217,076 B1
(45) Date of Patent: Apr. 17, 2001

(54) MAINTENANCE SCHEDULING AND TRACKING SYSTEM

(76) Inventors: Barbara L. Howard; John S. Howard, both of 1615 S. Mountain View Rd., Apache Junction, AZ (US) 85219

( * ) Notice: Subject to any disclaimer, the term of this patent is extended or adjusted under 35 U.S.C. 154(b) by 0 days.

(21) Appl. No.: 09/458,387

(22) Filed: Dec. 10, 1999

(51) Int. Cl.[7] ..... B42D 15/00; G09D 3/00

(52) U.S. Cl. ..... 283/2; 283/81; 283/36; 40/107; 40/121; 40/122; 40/110

(58) Field of Search ..... 283/81, 2, 36; 40/107, 110, 118–122, 5

(56) References Cited

U.S. PATENT DOCUMENTS

| | | | | |
|---|---|---|---|---|
| 4,612,620 | * | 9/1986 | Davis et al. | 364/551 |
| 4,888,692 | * | 12/1989 | Grupta et al. | 363/402 |
| 4,889,365 | * | 12/1989 | Chouinard | 283/70 |
| 5,090,733 | | 2/1992 | Bussiere . | |
| 5,220,668 | * | 6/1993 | Bullis | 395/650 |
| 5,230,938 | * | 7/1993 | Hess et al. | 428/42 |
| 5,334,431 | * | 8/1994 | Longtin | 283/81 |
| 5,352,155 | * | 10/1994 | Fahey | 283/81 |
| 5,367,624 | * | 11/1994 | Cooper | 345/357 |
| 5,542,024 | * | 7/1996 | Balint et al. | 345/356 |
| 5,570,109 | * | 10/1996 | Jenson | 345/146 |
| 5,581,486 | * | 12/1996 | Terada et al. | 364/569 |
| 5,737,726 | * | 4/1998 | Cameron et al. | 705/7 |
| 5,778,381 | * | 7/1998 | Sandifer | 707/104 |
| 5,799,423 | | 9/1998 | Malino . | |
| 5,813,539 | * | 9/1998 | Depalma | 383/39 |
| 5,860,067 | * | 1/1999 | Onda et al. | 345/341 |
| 5,941,915 | * | 8/1999 | Federle et al. | 701/1 |
| 5,943,051 | * | 8/1999 | Onda et al. | 345/341 |
| 5,987,474 | * | 11/1999 | Sandifer | 707/104 |
| 6,039,355 | * | 3/2000 | Durand | 283/2 |

* cited by examiner

*Primary Examiner*—A. L. Wellington
*Assistant Examiner*—Alisa L Thurston
(74) *Attorney, Agent, or Firm*—Jeffrey Weiss; Harry M. Weiss; Weiss & Moy, P.C.

(57) ABSTRACT

A property maintenance scheduling system has a calendar for displaying a current month. The calendar has an area for listing property maintenance to be performed during the month. The maintenance system further has two pluralities of labels. The first labels are to be placed on the calendar to indicate the date that specific maintenance is due to be performed. The second labels are to be placed on each item to record the date on which an item will next be serviced. The calendar may also be electronic in nature. A notebook may further be provided in the property maintenance scheduling system. The notebook is used for detailing the procedure for each property maintenance task to be performed during the month. The notebook may further be used for recording details of the work performed for each property maintenance task.

18 Claims, 3 Drawing Sheets

Suggested Intervals of Maintenance (This may vary in different climates)

| Task | Frequency Per Year |
|---|---|
| • Have house sprayed for insects | 9 |
| • Drain approximately 2 gallons of water from water heater | 6 |
| • Check for proper operation of water heater pressure relief valve | 2 |
| • Make sure fire extinguisher is full | 1 |
| • Check bolts and brackets on ceiling fans | 1 |
| • Change return air filters | 12 |
| • Clean or replace window air conditioner filter | 5 |
| • Turn off power to condenser coils and spray clear with hose | 3 |
| • Check for proper operation of sump pump | 4 |
| • Caulk or weather-strip all openings | 3 |
| • Clean coils on refrigerator | 4 |
| • Spray moving parts on garage doors w/silicone spray | 2 |
| • Clean gutters | 2 |
| • Change evaporator cooler pads and clean unit | 1 |
| • Check for proper operation of mailbox | 2 |
| • Clean light globes | 1 |
| • Clean fireplace chimney/check roof flashing | 2 |
| • Clean stove vent filter | 1 |

FIG. 8

MAINTENANCE SCHEDULING AND TRACKING SYSTEM

BACKGROUND OF THE INVENTION

1. Field of the Invention

This invention relates to property maintenance and, more specifically, to a maintenance scheduling system which would be used to help schedule and remind individuals when maintenance of items in and around a home or business need to be inspected and/or serviced.

2. Description of the Prior Art

People who own or maintain property must perform many different tasks in order to keep the property habitable. For example, many people routinely spray the property for insects; inspect and service the heating, ventilation and air conditioner (HVAC) unit; change the air conditioner air filter; drain water from the water heater unit; check the smoke alarm detector; etc. The problem is that many people forget to perform these functions. Even if one remembers to perform routine maintenance, they usually forget when the last time a system was inspected and/or serviced. Thus, many systems in a home or property may not perform properly or may even break down due to poor maintenance.

Therefore, a need existed to provide a maintenance scheduling system. The maintenance scheduling system would allow a user to track and/or schedule inspection and maintenance of items in and around a home or business.

SUMMARY OF THE INVENTION

In accordance with one embodiment of the present invention, it is an object of the present invention to provide a maintenance scheduling system.

It is another object of the present invention to provide a maintenance scheduling system which would allow a user to track and/or schedule inspection and maintenance of items in and around a home or business.

BRIEF DESCRIPTION OF THE PREFERRED EMBODIMENTS

In accordance with one embodiment of the present invention, a property maintenance scheduling system is disclosed. The property maintenance scheduling system has a calendar for displaying a current month. The calendar has an area for listing property maintenance to be performed during the month. In one embodiment of the present invention, the area for listing property maintenance to be performed during the month has pre-printed indicia listing each property maintenance task to be performed during the month.

The property maintenance scheduling system may further have two pluralities of labels. The first labels are to be placed on a calendar and are used to show what maintenance work is due to be performed on a particular date. The second labels are to be placed on each item that has been serviced and are used to show the future date of the next service.

A notebook may also be provided in the property maintenance scheduling system. The notebook is used for detailing the procedure for each property maintenance task to be performed during the month. The notebook may further be used for recording details of the work performed for each property maintenance task.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

FIG. 8 is an exemplary Suggested Intervals of Maintenance Table included with an alternate embodiment of the property maintenance scheduling system of the present invention.

DETAILED DESCRIPTION OF THE PREFERRED EMBODIMENT

Referring to FIGS. 1–5, a preferred embodiment of the property maintenance scheduling system (hereinafter the scheduling system) is shown. The scheduling system uses a calendar 10. The calendar 10 is used to display the current month of the year. The calendar 10 may be a pre-printed calendar or an electronic calendar which is stored in a computer (see FIG. 7), an electronic personal organizer (see FIG. 6) or the like.

Figure 3:
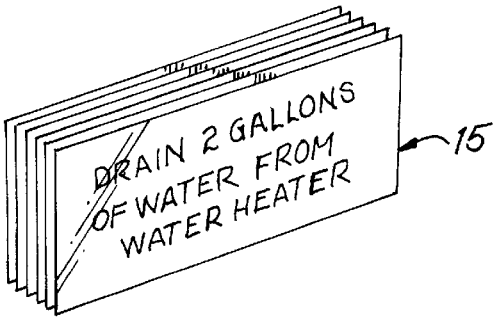
FIG. 3 is an elevated perspective view of the task labels used in the property maintenance scheduling system of the present invention.
Figure 4:
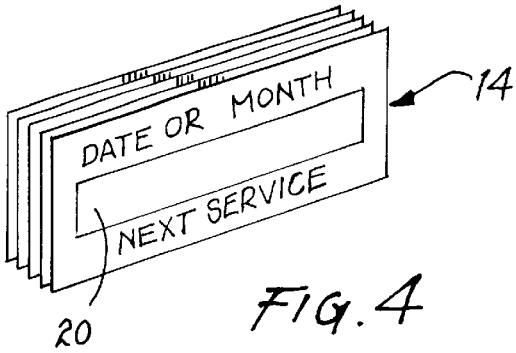
FIG. 4 is an elevated perspective view of the periodicity labels used in the property maintenance scheduling system of the present invention.
Figure 5:
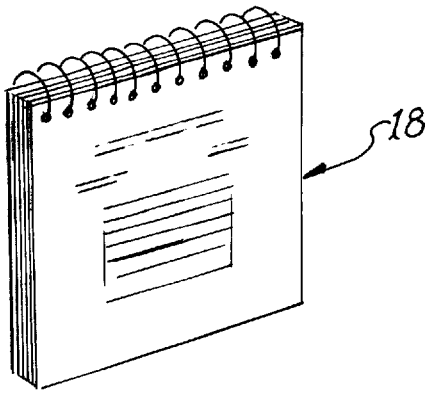
FIG. 5 is an elevated perspective view of the handbook used in the property maintenance scheduling system of the present invention.

The scheduling system will further include a plurality of periodicity labels 14. Each periodicity label 14 would be placed upon an item that had been serviced during the month and shows the next scheduled service date. As an example, FIG. 3 illustrates the periodicity label 14 placed on a water heater 16. Further, the periodicity label 14 upon the water heater 16 is to serve as a reminder as to when the next maintenance event is scheduled for the water heater 16 on which the periodicity label 14 is placed. Each periodicity label 14 thus has a date area 20 where a date could be recorded indicating when the next scheduled maintenance/service should be performed on the item.

Referring again to FIGS. 1, 6, and 7, in a preferred embodiment, the calendar 10 will have a section 12 that is used to display property maintenance tasks that need to be performed during the month currently displayed. The section 12 may be located on any visible area on the calendar 10. Some examples of property maintenance tasks for performance during any given month may include, but is not limited to: spraying the property for insects; inspecting and servicing the heating, ventilation and air conditioner (HVAC) unit; changing the air conditioner air filter; draining water from the water heater unit; checking the smoke alarm detector; etc.

Figure 1:
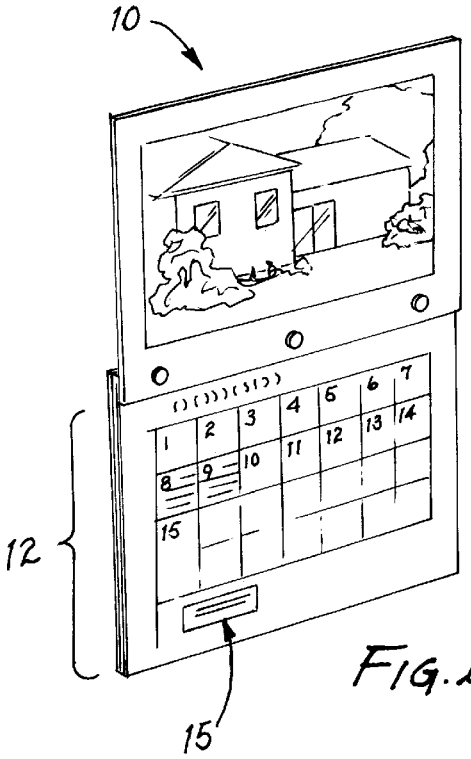
FIG. 1 is an elevated perspective view of one embodiment of a calendar used in the property maintenance scheduling system of the present invention.
Figure 2:
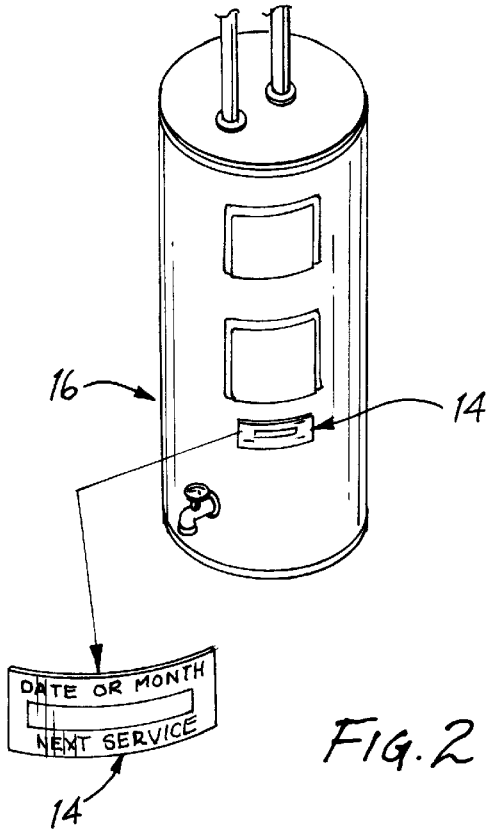
FIG. 2 is a front view of a label used in the property maintenance scheduling system of the present invention attached to a water heater.

In accordance with an alternate embodiment of the present invention, the calendar 10, as shown in FIG. 1, may be any conventional calendar purchased separately from the present invention. In this embodiment a plurality of task labels 15 are supplied, each having a task preprinted thereon. The task labels 15 are placed upon the section 12 of the calendar 10, wherein the section 12 is blank of other than the conventional calendar indicia. By having the section 12 blank, the user is allowed to list the tasks that need to be performed during any given month upon a particular day or days. Referring to FIG. 8, an exemplary Suggested Intervals of Maintenance table is shown. The Suggested Intervals of Maintenance table lists suggested maintenance tasks to be performed and a suggested periodicity for the tasks. The task labels 15 may be placed upon the section 12 of the calendar 10 according to the Suggested Intervals of Maintenance table. Those skilled in the art will recognize that an individual user of the present invention is free to depart from the suggested task frequency of FIG. 8 as they desire or as needs dictate, without departing from the spirit and cope of the present invention.

As those skilled in the art will appreciate, the calendar 10 may also comprise a combination of: pre-printed tasks, task labels 15, and blank spaces to allow the writing in, or hand addition, of tasks.

The scheduling system may further include a handbook 18. The handbook 18 would be used for two main purposes. First, the handbook 18 would delineate the maintenance requirements in expanded detail for each maintenance event. Thus, for example, the handbook 18 would provide detailed instructions on how to properly spray the property for insects, safely drain water from the water heater 16, etc. The handbook 18 could further be used as a maintenance diary. Thus, the handbook 18 could be used to record information about each maintenance event. Information, such as, what work/maintenance was performed, when the work/maintenance work was performed, who performed the work/maintenance, etc.

Figure 6:
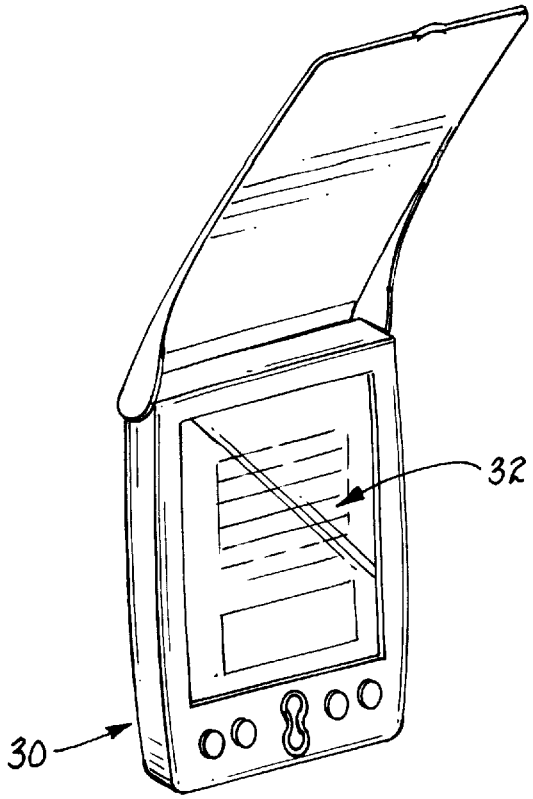
FIG. 6 is an elevated perspective view of the handheld personal organizer used in an alternate embodiment of the property maintenance scheduling system of the present invention.
Figure 7:
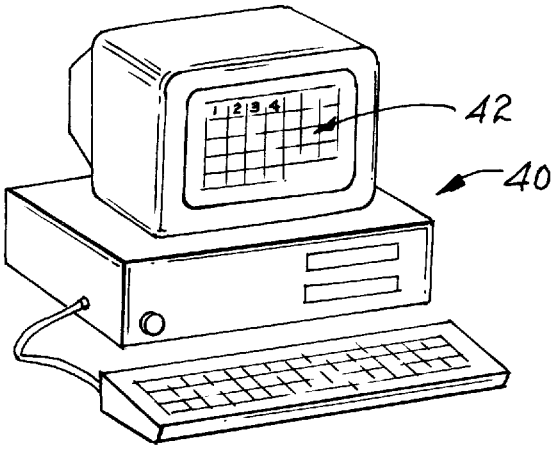
FIG. 7 is a front view of the personal computer used in an alternate embodiment of the property maintenance scheduling system of the present invention.

Referring to FIG. 6, an elevated perspective view of a handheld personal organizer 30 used in an alternate embodiment of the property maintenance scheduling system of the present invention is shown. Referring to FIG. 7, a front view of a personal computer 40 used in a further alternate embodiment of the property maintenance scheduling system of the present invention is shown. In either of the above alternate embodiments, the scheduling system is programmed in one or more embodiments in any of a variety of fashions, well known to those skilled in the art. The software program may cause to be presented upon the display screen 32 of the handheld personal organizer 30, and/or the display screen 42 of the personal computer 40, the calendar 10 as depicted in FIG. 1, and its section 12 for display and user entry of property maintenance tasks. Additionally, the software program may also incorporate the features of the handbook 18 as previously described. Additionally, the property maintenance tasks may also be placed into the software program so as to cause the software program to alert the user with an audible or visual alarm in a manner well known to those skilled in the art in addition to other features possible in a software environment.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A property maintenance scheduling system comprising:

a calendar for displaying a current month;

wherein said calendar has an area for listing property maintenance services to be performed in a home and affecting items within said home during said month; and at least one of a first plurality of labels to be placed on said items that have received said property maintenance services listed on said calendar specifying said property maintenance services that have been performed and a second plurality of labels to be placed on said items indicating a due date for the next said property maintenance services to be performed on said items.

2. A property maintenance scheduling system in accordance with claim 1 further comprising a notebook for detailing said property maintenance services to be performed during said month.

3. A property maintenance scheduling system in accordance with claim 2 wherein said notebook is further used for recording said property maintenance services performed during said month.

4. A property maintenance scheduling system in accordance with claim 1 wherein said area for listing said property maintenance services to be performed during said month has pre-printed indicia listing said property maintenance services to be performed during said month.

5. A property maintenance scheduling system in accordance with claim 1 wherein said calendar is a printed calendar.

6. A property maintenance scheduling system in accordance with claim 1 wherein said calendar is an electronic calendar.

7. A property maintenance scheduling system comprising, in combination:

a calendar for displaying a current month wherein said calendar has an area for listing property maintenance services to be performed in a home and affecting items within said home during said month;

a first plurality of labels to be placed on items that have received said property maintenance services listed on said calendar specifying said property maintenance services that have been performed;

a second plurality of labels to be placed on said items indicating a due date for the next said property maintenance services to be performed on said items; and a notebook for detailing said property maintenance services to be performed during said month.

8. A property maintenance scheduling system in accordance with claim 7 wherein said notebook is further used for recording said property maintenance service performed during said month.

9. A property maintenance scheduling system in accordance with claim 7 wherein said area for listing said property maintenance services to be performed during said month has pre-printed indicia listing said property maintenance services to be performed during said month.

10. A property maintenance scheduling system in accordance with claim 7 wherein said calendar is a printed calendar.

11. A property maintenance scheduling system in accordance with claim 7 wherein said calendar is an electronic calendar.

12. A property maintenance scheduling system comprising, in combination:

a calendar for displaying a current month wherein said calendar has pre-printed indicia listing property maintenance services to be performed in a home and affecting items within said home during said month;

a first plurality of labels to be placed on said items that have received said property maintenance services listed on said calendar specifying said property maintenance services that have been performed according to said property maintenance scheduling system; and a second plurality of labels to be placed on said items indicating a due date for the next said property maintenance services to be performed on said items.

13. A property maintenance scheduling system in accordance with claim 12 further comprising a notebook for detailing a procedure for each task of said property maintenance services to be performed during said month.

14. A property maintenance scheduling system in accordance with claim 13 wherein said notebook is further used for recording an action performed for each of said task of said property maintenance services performed during said month.

15. A property maintenance scheduling system in accordance with claim 12 herein said area for listing said property maintenance services to be performed during said month has pre-printed indicia listing said property maintenance services to be performed during said month.

16. A property maintenance scheduling system in accordance with claim 12 wherein said calendar is a printed calendar.

17. A property maintenance scheduling system in accordance with claim 12 wherein said calendar is an electronic calendar.

18. A property maintenance scheduling system in accordance with claim 12 wherein said labels show which of said property maintenance services has been performed on said item.

* * * * *